US006199789B1

(12) United States Patent
Marco

(10) Patent No.: US 6,199,789 B1
(45) Date of Patent: Mar. 13, 2001

(54) WINDING OR REWINDING MACHINE FOR FORMING LARGE-DIAMETER REELS OF WEBLIKE MATERIAL

(75) Inventor: Celli Marco, Capannori (IT)

(73) Assignee: A. Celli S.p.A. (IT)

( * ) Notice: Subject to any disclaimer, the term of this patent is extended or adjusted under 35 U.S.C. 154(b) by 0 days.

(21) Appl. No.: 09/322,578

(22) Filed: May 28, 1999

(30) Foreign Application Priority Data

Jun. 1, 1998 (IT) ..... FI98A0131

(51) Int. Cl.[7] ..... B65H 18/20; B65H 19/30

(52) U.S. Cl. ..... 242/533.7; 242/542.2

(58) Field of Search ..... 242/542.2, 541.1, 242/541.4, 541.5, 541.6, 541.7, 533.7

(56) References Cited

U.S. PATENT DOCUMENTS

| | | | | |
|---|---|---|---|---|
| 1,875,861 | * | 9/1932 | Eckstein | 242/542.2 |
| 2,090,130 | * | 8/1937 | Kittel | 242/541.1 |
| 2,141,629 | | 12/1938 | Warner et al. . | |
| 2,736,508 | * | 2/1956 | Langbo | 242/542.2 |
| 2,772,838 | * | 12/1956 | Lenz | 242/533.7 |
| 3,057,572 | | 10/1962 | Rockstrom et al. . | |
| 3,441,234 | * | 4/1969 | Barten | 242/542.2 |
| 3,675,866 | * | 7/1972 | Lemke et al. | 242/533.7 |
| 3,727,853 | * | 4/1973 | Kinoshita | 242/533.7 |
| 3,727,854 | | 4/1973 | Grotzbach . | |
| 3,841,578 | | 10/1974 | Dörfel . | |
| 3,995,747 | * | 12/1976 | Lewey et al. | 242/533.7 |
| 4,157,794 | | 6/1979 | Brandauer et al. . | |
| 4,223,850 | * | 9/1980 | Alexander | 242/542.2 |
| 4,338,147 | | 7/1982 | Bäckström et al. . | |
| 4,422,588 | | 12/1983 | Nowisch . | |
| 4,431,142 | * | 2/1984 | Kataoka | 242/533.7 |
| 4,456,190 | | 6/1984 | Karttunen et al. . | |
| 4,602,749 | * | 7/1986 | Vanhoutte | 242/542.2 |
| 4,811,915 | | 3/1989 | Smith . | |
| 4,817,883 | | 4/1989 | Hoffmann et al. . | |
| 6,047,916 | * | 4/2000 | Onnerlov | 242/542.2 |

FOREIGN PATENT DOCUMENTS

| | | |
|---|---|---|
| 740707 | 9/1943 | (DE) . |
| 0 826 115 | 11/1996 | (EP) . |
| 0 754 640 A2 | 1/1997 | (EP) . |
| 2 050 317 | 1/1981 | (GB) . |
| 2 087 362 | 5/1982 | (GB) . |

* cited by examiner

*Primary Examiner*—John M. Jillions
(74) *Attorney, Agent, or Firm*—McGlew and Tuttle, P.C.

(57) ABSTRACT

The rewinding machine comprises a pair of lower winding rolls (11, 13) defining a winding cradle, which are movable from an upper position toward a lower position during the winding of a reel (R), in order to keep the axis of the developing reel in an essentially fixed position.

40 Claims, 14 Drawing Sheets

WINDING OR REWINDING MACHINE FOR FORMING LARGE-DIAMETER REELS OF WEBLIKE MATERIAL

DESCRIPTION

1. Technical Field

The present invention relates to a winding or rewinding machine for the production of reels of wound weblike material, such as reels of paper, nonwoven or the like, and a corresponding winding method.

More specifically, the present invention relates to a machine of the kind that comprises a pair of lower supporting rolls on which is formed the roll or reel of weblike material or a plurality of axially aligned reels, and means for inserting winding cores into a cradle defined by said two rolls.

2. State of the Art

Reels of weblike material of relatively large diameter are currently produced on winding or rewinding machines comprising a pair of motorized lower rolls, also known as traction rolls, on which is laid a tubular member or winding core on which the reel of material is formed. Above the two motorized lower rolls there is usually a movable third or pressure winding roll which follows the growth of the reel during winding and allows the pressure on it to be adjusted in order to achieve uniform winding.

Machines of this kind are usually equipped with blades that cut the incoming weblike material to divide it into longitudinal strips which are then wound onto a plurality of separate, axially aligned winding cores in order to simultaneously produce a plurality of reels. This text will refer in a general way to the winding of a reel but it is intended that this term should be understood as meaning either a single reel or a plurality of axially aligned reels formed simultaneously by the winding of strips of weblike material.

Machines of this kind are described, for example, in U.S. Pat. No. 4,422,588, U.S. Pat. No. 157,794, U.S. Pat. No. 3,727,854, U.S. Pat. No. 4,456,190, U.S. Pat. No. 4,338,147, U.S. Pat. No. 3,057,572, U.S. Pat. No. 4,811,915, U.S. Pat. No. 4,817,883, U.S. Pat. No. 3,841,578, GB-A-2,087,362 and GBA-2,050,317.

In known rewinding machines of this type, the lower rolls have fixed axes and the reel of weblike material that is being wound grows with a gradual movement of the reel axis away from the winding cradle defined by the two lower winding rolls, also known as supporting rolls. U.S. Pat. No. 3,841,578 also provides for a movement of the axes of the lower winding rolls, but this is only in order to allow insertion of the winding core which is inserted from below after a certain quantity of weblike material has been wound onto it.

In many cases, owing to the great weight of material which is wound onto the reel, a mandrel is inserted inside the tubular winding core to stiffen the reel axially during the winding process.

When a winding mandrel is used inside the tubular core, its vertical movement during the winding process places limits on its use and on the functions which it can perform during the winding.

SUMMARY OF THE INVENTION

In order to improve the functioning of rewinding machines of the type discussed above and make them more efficient and more reliable, according to the present invention the lower winding rolls are movable from an upper position toward a lower position during the winding of a reel, in order to keep the axis of the developing reel in an essentially fixed position. This makes it possible to use a winding mandrel which is inserted axially into the winding zone above the two lower winding rolls. The mandrel remains in a fixed axial position and is therefore easy to motorize. This facilitates winding in the case of very large reels. Furthermore, because there is only one mandrel and it is not recycled around the machine, as happens in some currently used rewinders, the size and weight of the mandrel can actually be made considerable in order to increase its strength. A support at both ends of the mandrel, on the two side frames of the machine, can if required be used to increase the strength of the mandrel and hence the reliability of operation of the machine even at high winding speeds.

The winding mandrel is preferably expandable, in a manner known per se.

The movement of insertion and withdrawal of the mandrel into and out of the winding zone may take place in various ways. In one particularly advantageous embodiment of the invention, use may be made of a pair of motorized shaped rolls that engage with friction on the external surface of said winding mandrel in order to move it axially. The shaped rolls may advantageously be adjustable to enable them to act on winding mandrels of different diameters.

In one particularly advantageous embodiment of the invention, the lower winding rolls are supported by pivoting arms. This makes the roll movement system very simple. Moreover, by gradually pivoting the winding rolls downward, the winding rolls are also caused to move away from each other. This increases the support base of the developing reel because the lines of support of the reel on the winding rolls are moving further and further apart. This increases the reliability of operation of the machine.

Theoretically the machine could perform winding directly on the axial mandrel, which is then extracted from the finished reel so that the finished reel has no winding core. However, in a preferred embodiment of the invention, the winding takes place on tubular cores into which the winding mandrel is inserted in an axial direction, in which case the machine also comprises a means for introducing tubular winding cores. This introducing means may be variously configured and arranged in accordance with one of the known solutions of the prior art. For example, if there is sufficient space, the cores can be inserted axially directly into the winding cradle between the lower winding rolls, typically from the opposite side of the machine to that on which the winding mandrel is supported. In a preferred embodiment, however, the introducing means is situated underneath the lower winding rolls, in a central position relative to the axes of said lower winding rolls. The result is to reduce the space occupied by the machine. It also avoids the use of complicated mechanisms for inserting the cores from above, which have to rotate about one of the winding rolls, as used in certain conventional machines. The winding cores of a reel can be inserted into the introducing means while the previous reel is being wound.

The machine preferably also has a third or upper winding roll, often known as a rider, acting in combination with the two lower winding rolls.

Other features of the machine according to the invention and of the method employed with said machine are indicated in the attached claims.

BRIEF DESCRIPTION OF THE DRAWINGS

A clearer understanding of the invention will be gained from the description and attached drawing, the latter showing a practical, nonrestrictive example of an embodiment of the invention. In the drawing.

DETAILED DESCRIPTION OF THE PREFERRED EMBODIMENT 0F THE INVENTION

Figure 1:
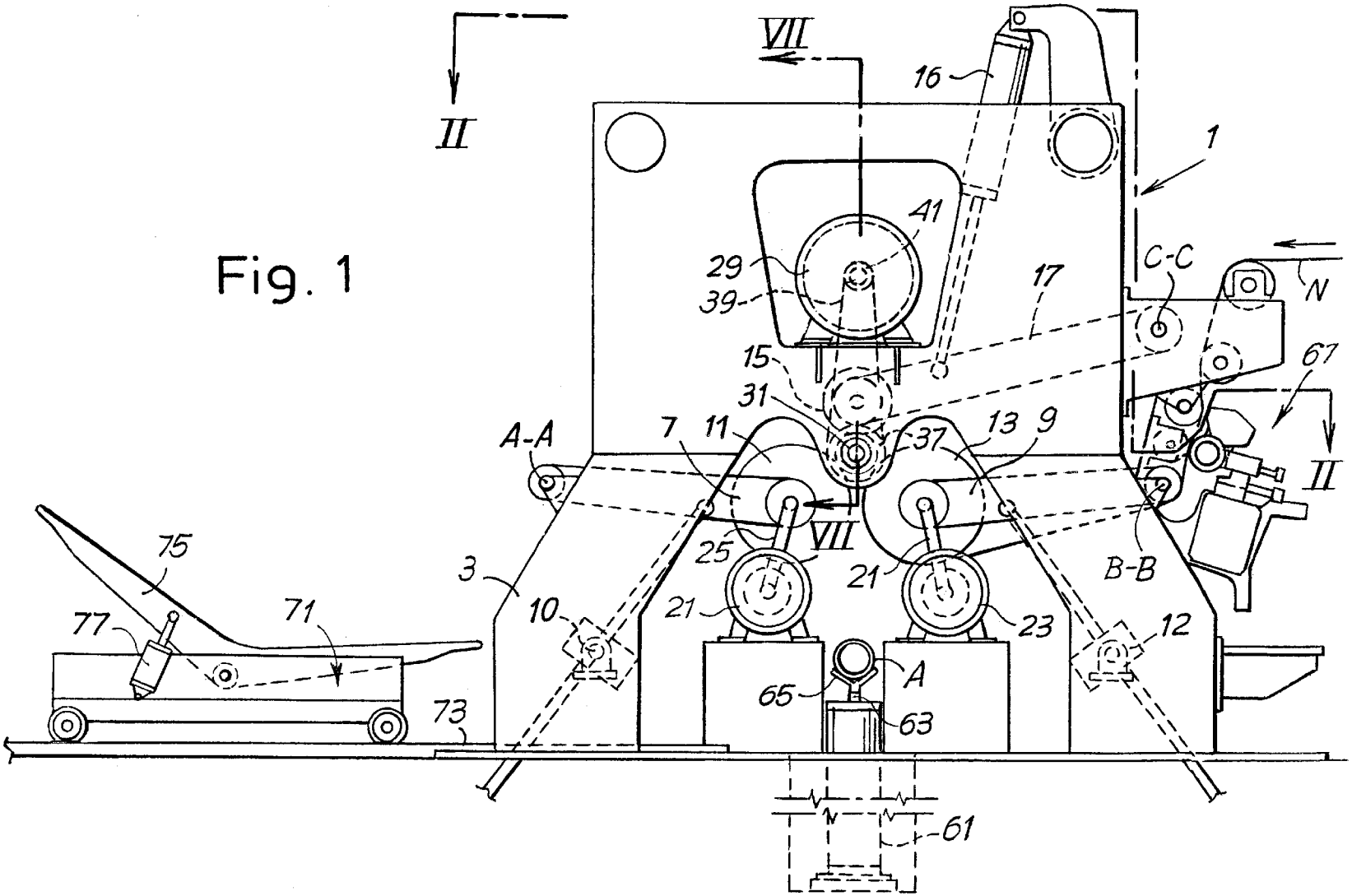
FIG. 1 shows a schematic side view of the machine according to the invention.

The machine, which is given the general reference 1, comprises a pair of side frames 3, 5 between which are pivoted two pairs of arms 7, 9. The pair of arms 7, pivoted about an axis A—A, carries a first lower winding roll 11, while the second pair of arms 9, pivoted about an axis B—B, carries a second lower winding roll 13. The two winding rolls 11, 13 are positioned side by side and define a winding cradle for the reel of weblike material, as will be explained below. They can each be pivoted about their respective pivot axes A—A and B—B by means of a threaded bar and nut system with the general references 10 and 12, the threaded bar being hinged to its respective arm 7, 9. As an altemative, other types of actuators, such as cylinder-and-piston actuators, can be used.

Above the two lower winding rolls 11, 13 is a third winding roll 15 carried by a pair of pivoting arms 17 hinged about an axis C—C to the side frames 3, 5 of the machine. The number 16 denotes an actuator used to raise and lower the roll 15.

Figure 2:
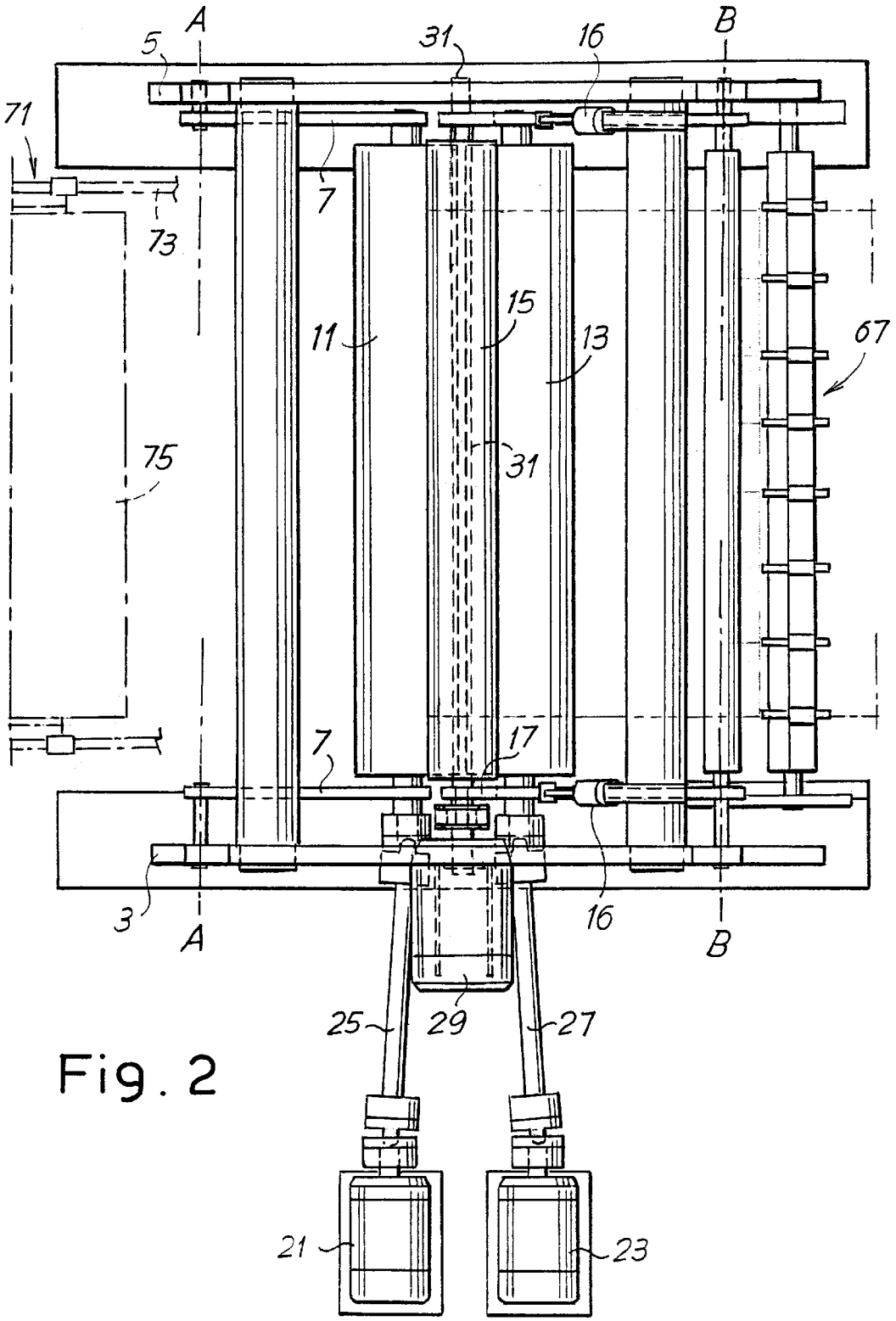
FIG. 2 shows a plan view on II—II as marked in FIG. 1.

The lower winding rolls 11, 13 are turned by two motors 21, 23 which (in the example illustrated) are set in fixed positions and connected to the axes of the lower winding rolls 11, 13 by two constant-velocity joints 25, 27 (see FIG. 2). In this way the two lower winding rolls 11, 13 are free to pivot about the axes A—A, B—B. Altematively, the motors 21, 23 could be supported in line with their respective winding rolls 11, 13, or could be supported by the side frames 3, 5 coaxially with the pivot axes A—A and B—B of the arms 7, 9, with a belt or equivalent drive to pulleys keyed to the shafts of the two lower winding rolls 11, 13.

Figure 7:
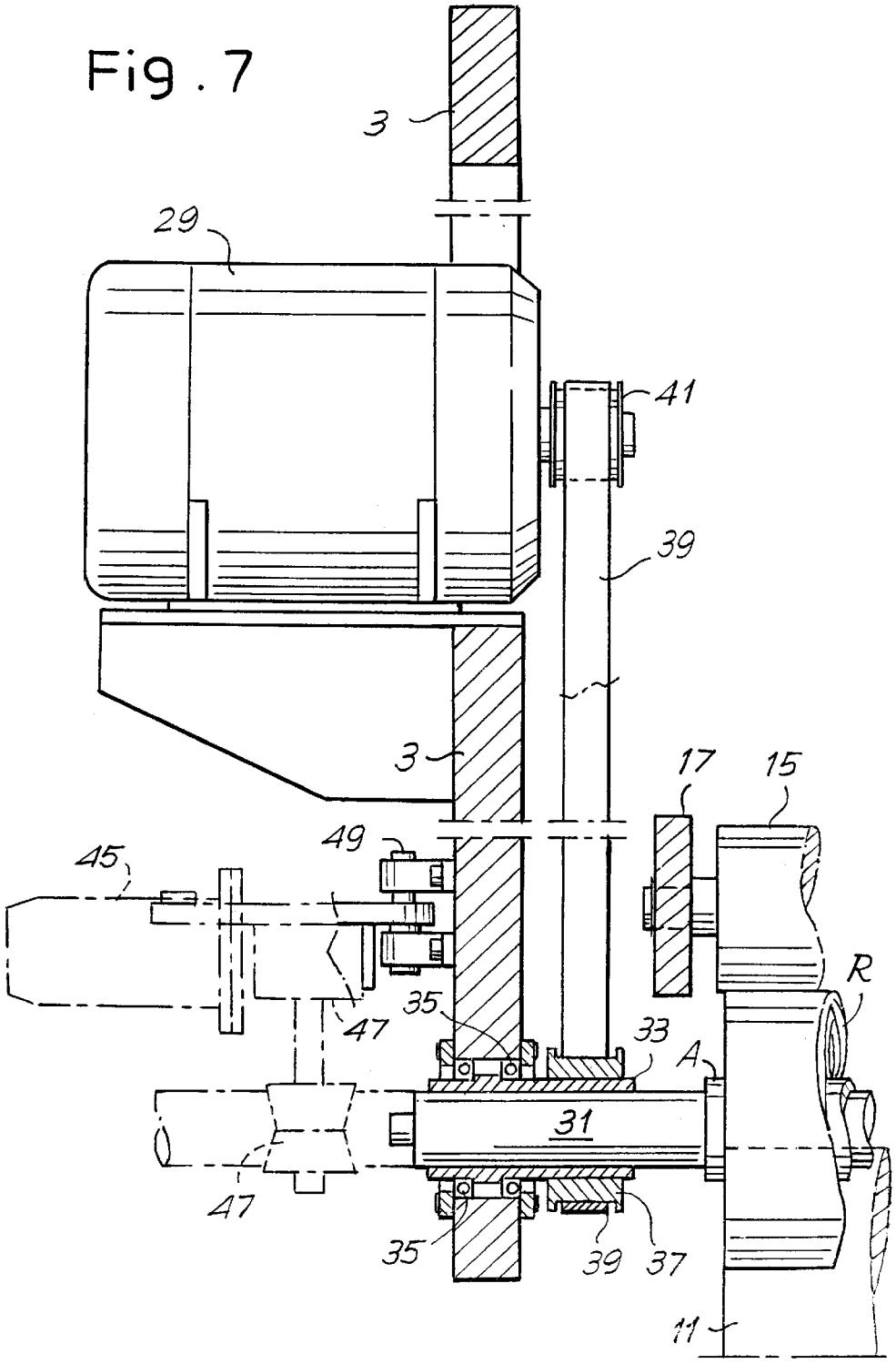
FIG. 7 shows a partly sectioned view on VII—VII as marked in FIG. 1, of the drive of the mandrel.

Mounted on the side frame 3 of the machine is another motor 29 used to turn a mandrel 31 indicated by dots and dashes in FIG. 2, located in an essentially fixed axial position such as to allow its insertion into a tubular core, or into a series of tubular cores lined up axially in the cradle defined between the lower winding rolls 11, 13. FIG. 7 shows a partially sectional view of the mechanical connection (omitted in order to simplify the drawing in FIGS. 1 and 2) between the motor and the mandrel 31. The mandrel 31 is of expandable type (known to those skilled in the art) and is inserted into a sleeve 33 supported by bearings 35 in the side frame 3. Expansion of the mandrel 31 locks it axially inside the sleeve 33. Keyed to the latter is a pulley 37 carrying a belt 39 which takes its motion from the motor 29 via a drive pulley 41. With this arrangement, when the mandrel 31 is not in its expanded condition, it can be slid axially through the sleeve 33 for insertion into and withdrawal from the winding zone defined between the lower winding rolls 11, 13 and the upper winding roll 15, while maintaining an essentially fixed axial position.

Figure 3:
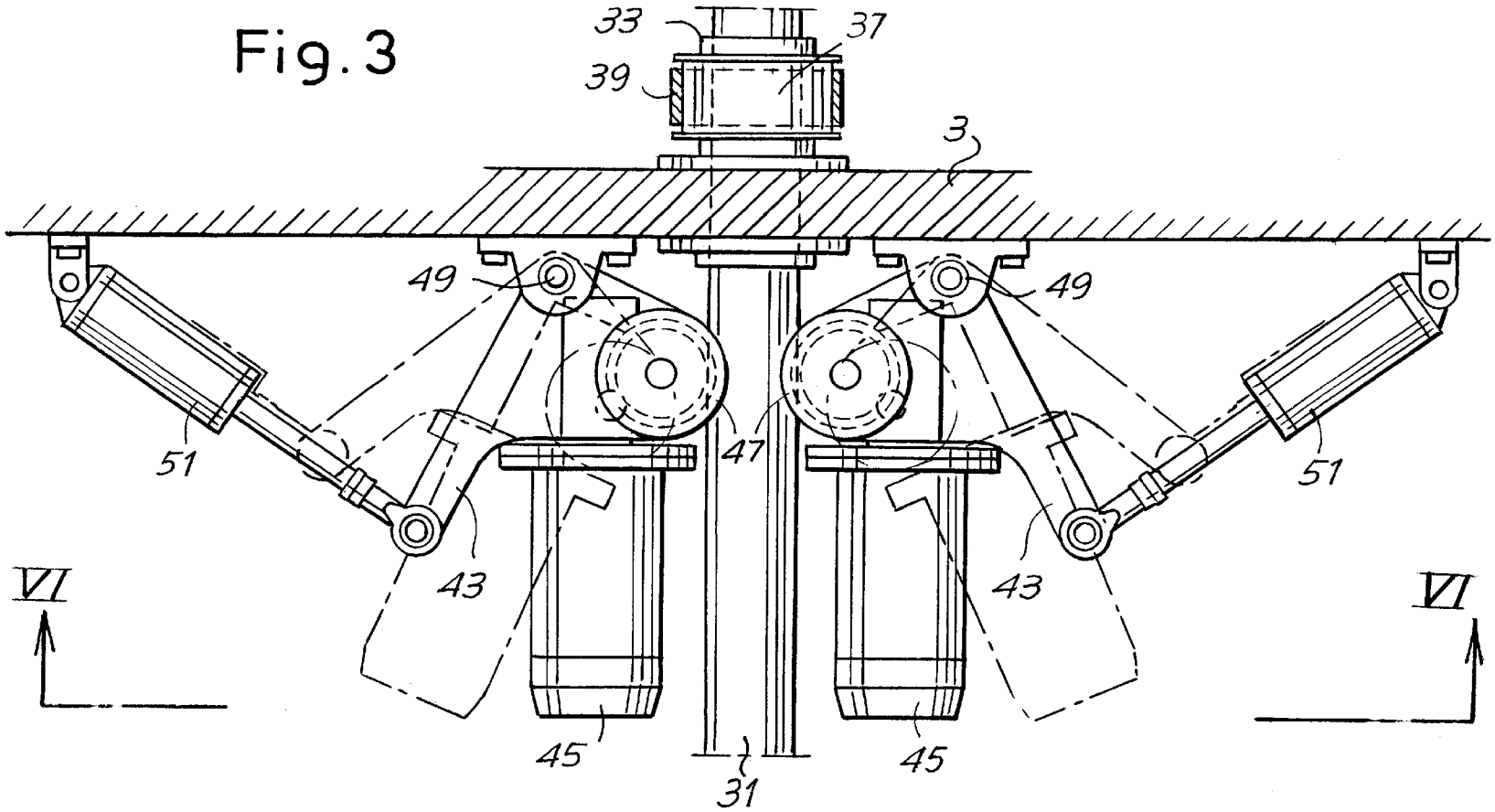
FIG. 3 shows a plan view of the withdrawal means for withdrawing the winding mandrel.
Figure 4:
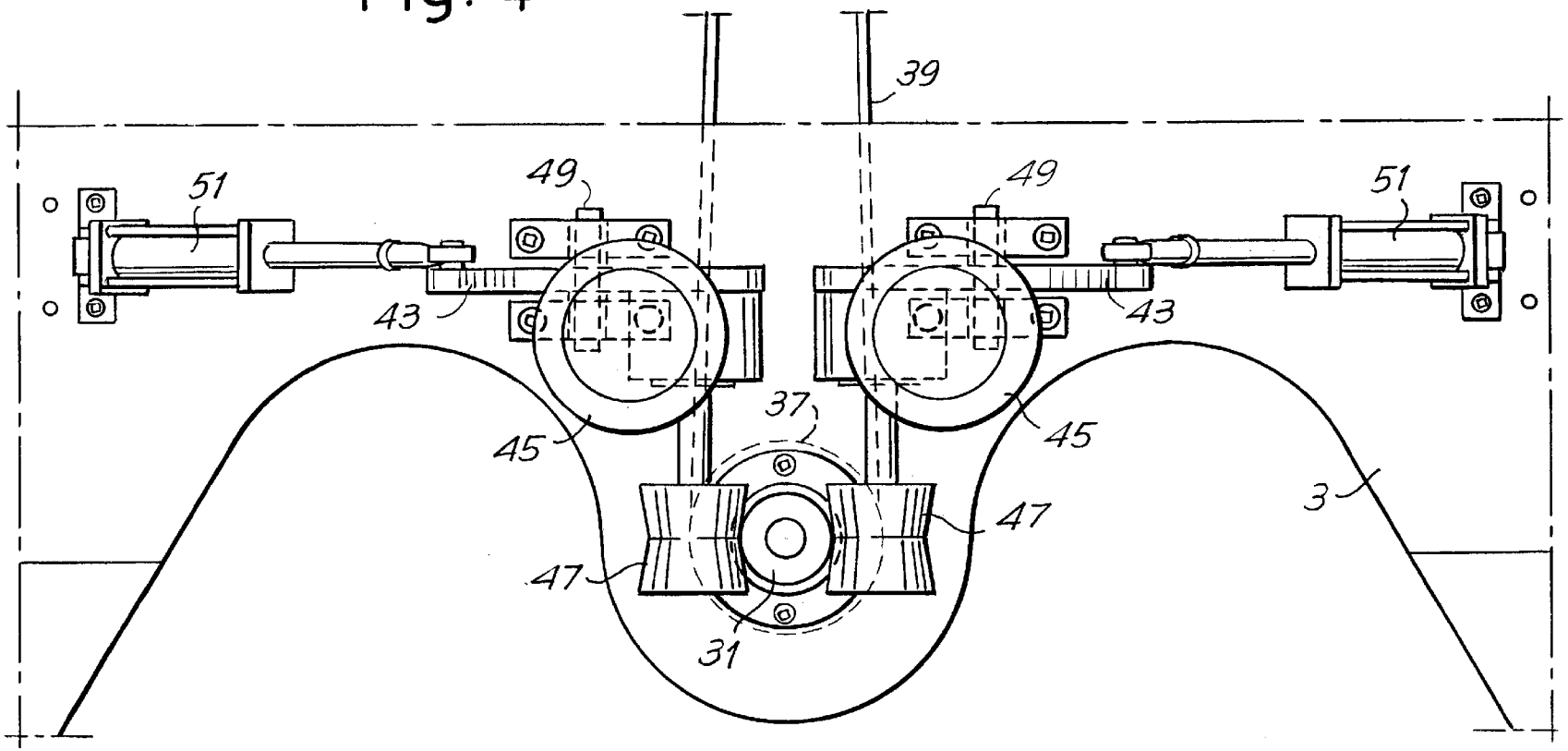
FIG. 4 shows a front view on IV—IV as marked in FIG. 3.

Axial movement of the mandrel 31 is obtained with an arrangement illustrated in FIGS. 3 and 4 and omitted in order to keep the drawing clear in FIGS. 1 and 2. Hinged to the side frame 3 are two supports 43 supporting respective geared motors 45 which drive two shaped rolls 47 covered in a material with a high coefficient of friction, rubber for example. The two supports 43 can be pivoted about respective hinges 49 by two cylinder-and-piston actuators 51. In this way the two shaped rolls 47 can be moved either into or out of contact with the cylindrical surface of the mandrel 31. When it is wished to move the mandrel 31 axially, the shaped rolls 47 are pressed against the surface of the mandrel and rotated by the geared motors 45.

Figure 5:
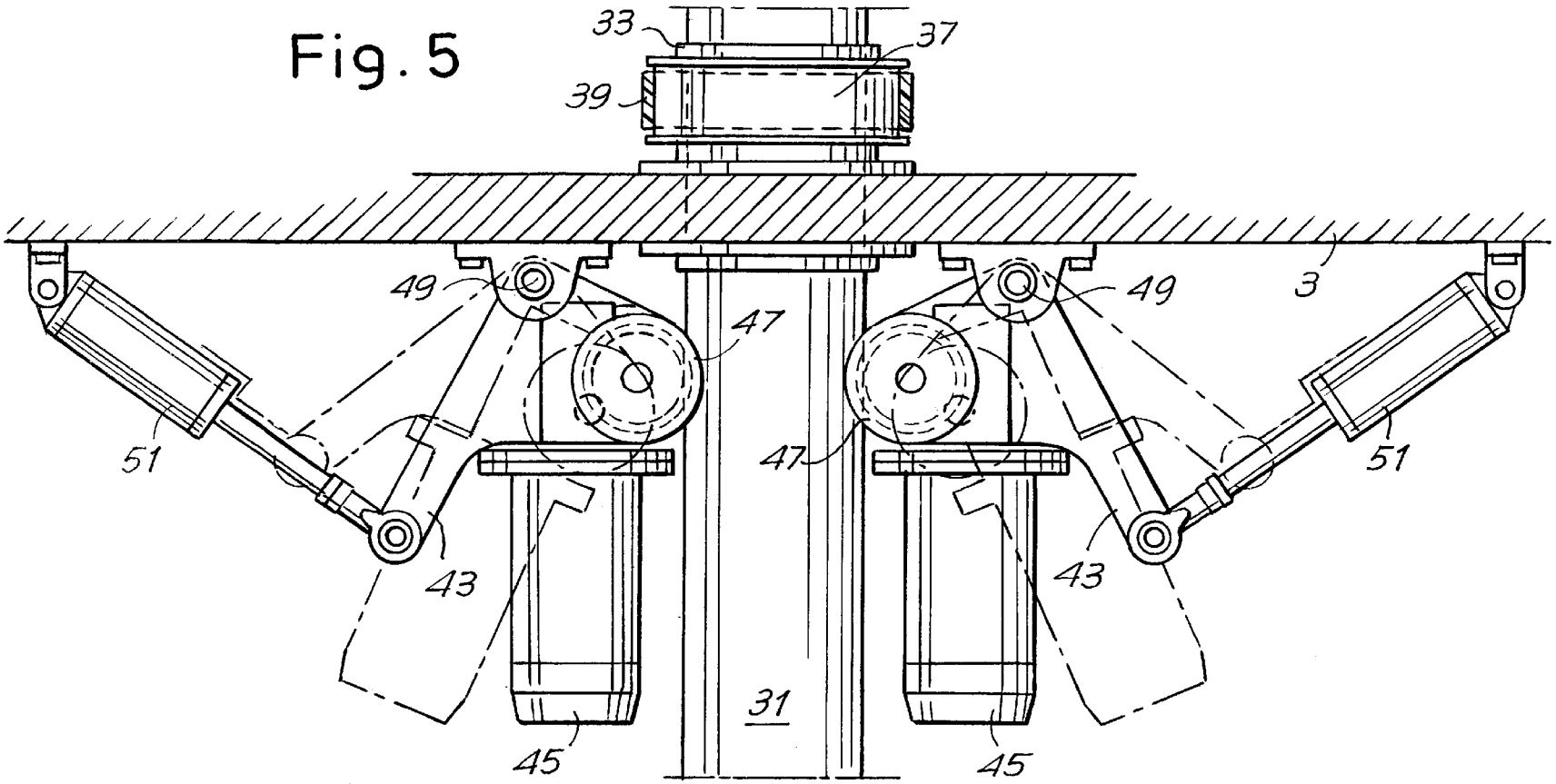
FIGS. 5 and 6 show views similar to those of FIGS. 3 and 4 for a larger-diameter mandrel.
Figure 6:
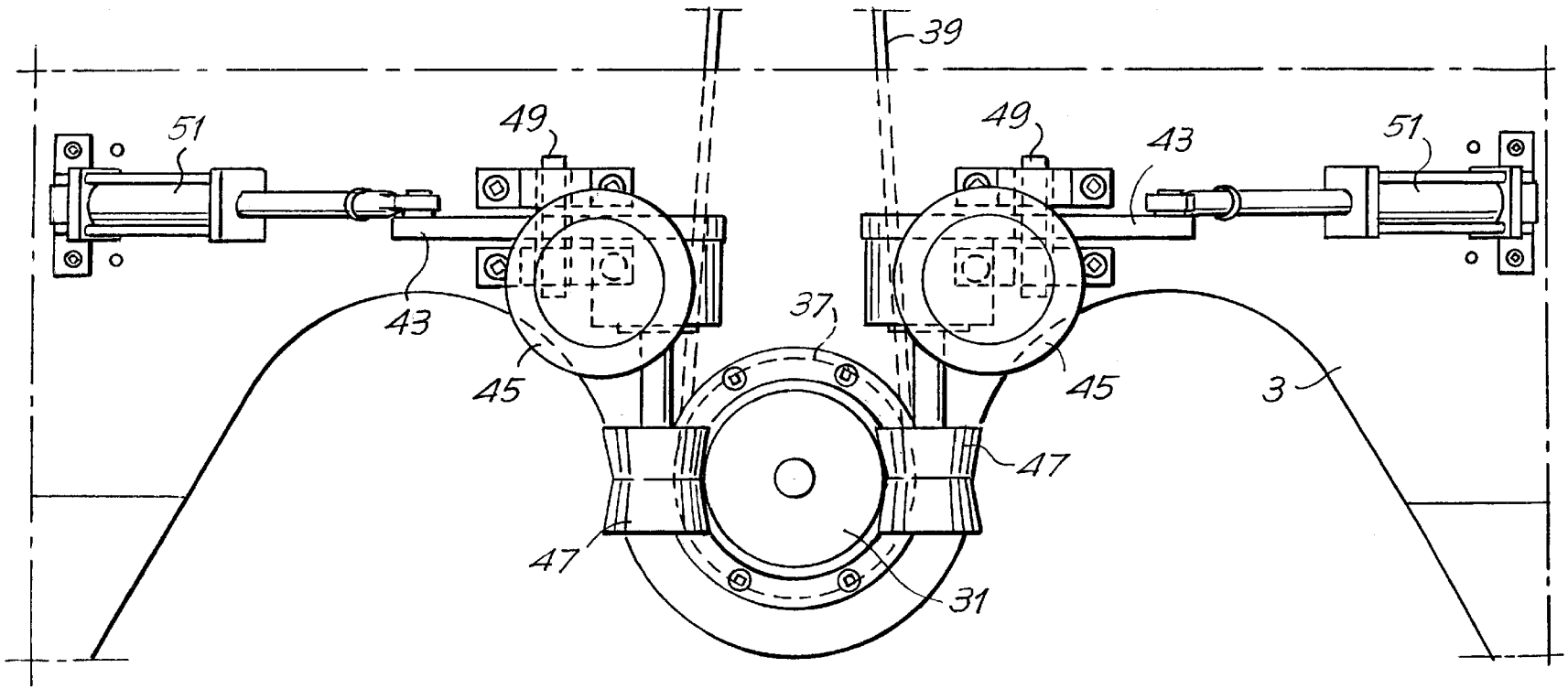

As can be seen by comparison of FIGS. 3, 4 and 5, 6, the system can easily be adapted to mandrels 31 of different diameters, FIGS. 5 and 6 showing a mandrel of larger diameter than that shown in FIGS. 3 and 4.

Lower down, beneath the lower winding rolls 11, 13 and partly underneath the surface on which the machine 1 stands is a winding core introducing means schematically depicted by a cylinder-and-piston system 61 whose rod 65 carries a V section. The tubular cores A (see FIG. 1) are placed on the V section from the exterior by an insertion movement parallel to the axis of the tubular cores.

The number 67 is a general reference for a system of adjustable blades located in the inlet zone where the weblike material N enters the machine 1. The blades are of a type known per se and will not be explained in further detail here.

On the output side of the machine 1 is a carriage 71 traveling on tracks 73 ending under the first lower winding roll 11. The carriage 71 is equipped with a pivoting cradle 75 designed to take the reels formed by the machine 1. Its pivoting is controlled by an actuator 77. The pivoting cradle 75 can be raised and lowered vertically to receive reels of varying dimensions.

Figure 8:
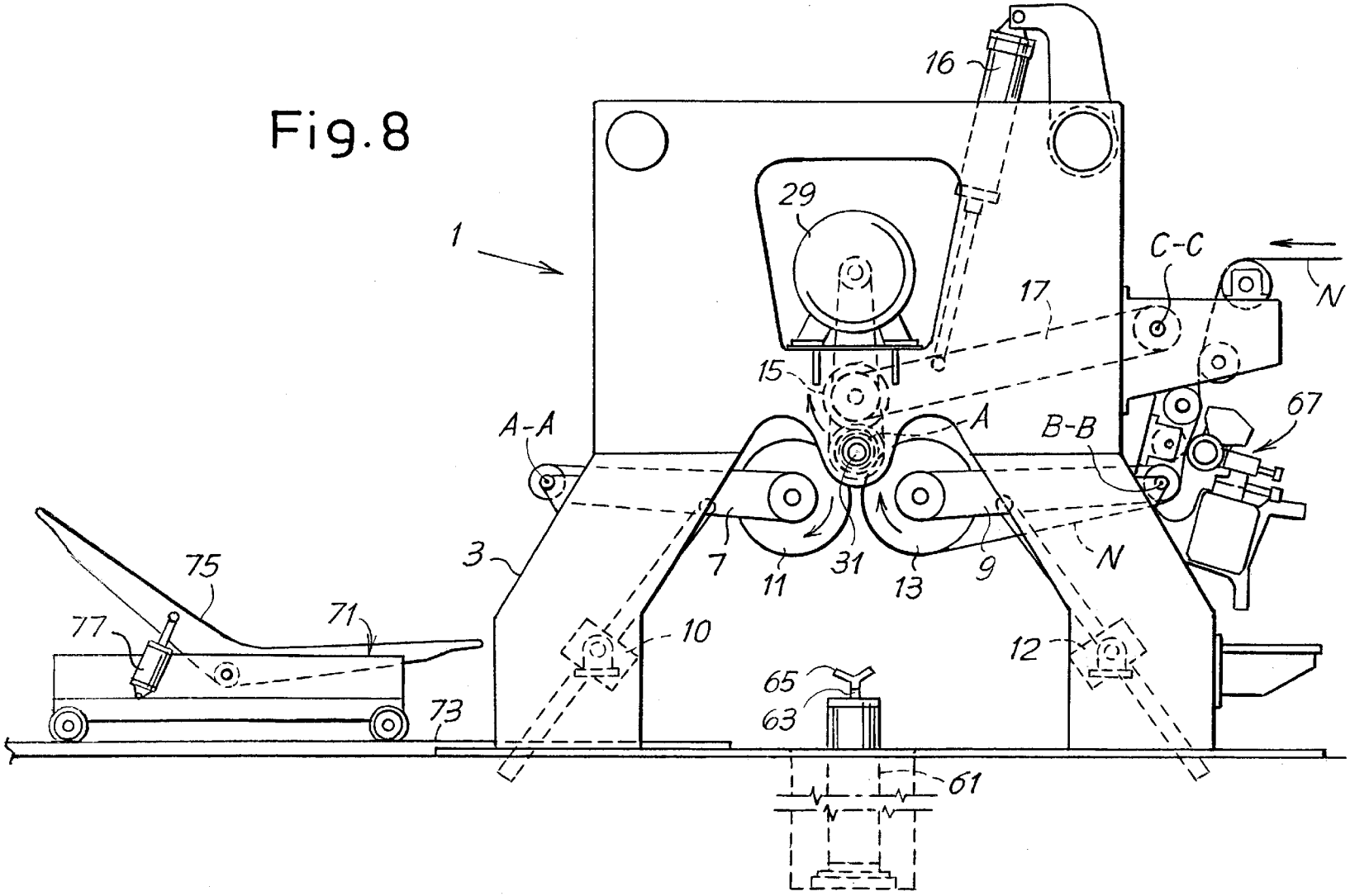
FIGS. 8–11 show various conditions of the machine in side view during the work cycle.

The operation of the machine will be described below with reference to FIGS. 8–11. Shown in FIG. 8 is the condition of the machine at the start of the winding cycle. A new tubular core A, or a series of axially aligned tubular cores A, has been inserted into the winding cradle and the lower winding rolls 11, 13 are in their highest position, while the upper winding roll 15 is in its lowest position. The three rolls 11, 13, 15 are therefore in contact with the winding core or cores. The winding mandrel 31 has been inserted into the tubular cores and expanded so as to grip them. The rotation of the mandrel 31 by the motor 29 and the rotation of the lower winding rolls 21, 23 causes rotation of the tubular cores, on which a line of glue has previously been applied, in order that the starting end of the weblike material N will stick to them. The latter reaches the winding zone already cut by the blades 67 into longitudinal strips, so that one strip of weblike material is wound onto each of the tubular cores positioned on the mandrel 31. If it is wished to produce a single reel of large axial dimension, the weblike material N may reach the winding zone without first being cut. In this case one tubular winding core is placed on the winding mandrel 31.

As the reel or reels of weblike material increase in diameter, the lower winding rolls 11 and 13 are lowered by pivoting them about the axes A—A and B—B, by means of the threaded rod and nut actuators 10, 12. In a similar way the upper winding roll 15 is gradually raised by the actuator 16. In this way the axis of the developing reel is kept essentially stationary and coinciding with the axis of rotation of the mandrel 31. The gradual lowering and separating of the lower winding rolls 11, 13 increases the base on which the reel is supported during its formation, thereby giving it greater stability.

Figure 9:
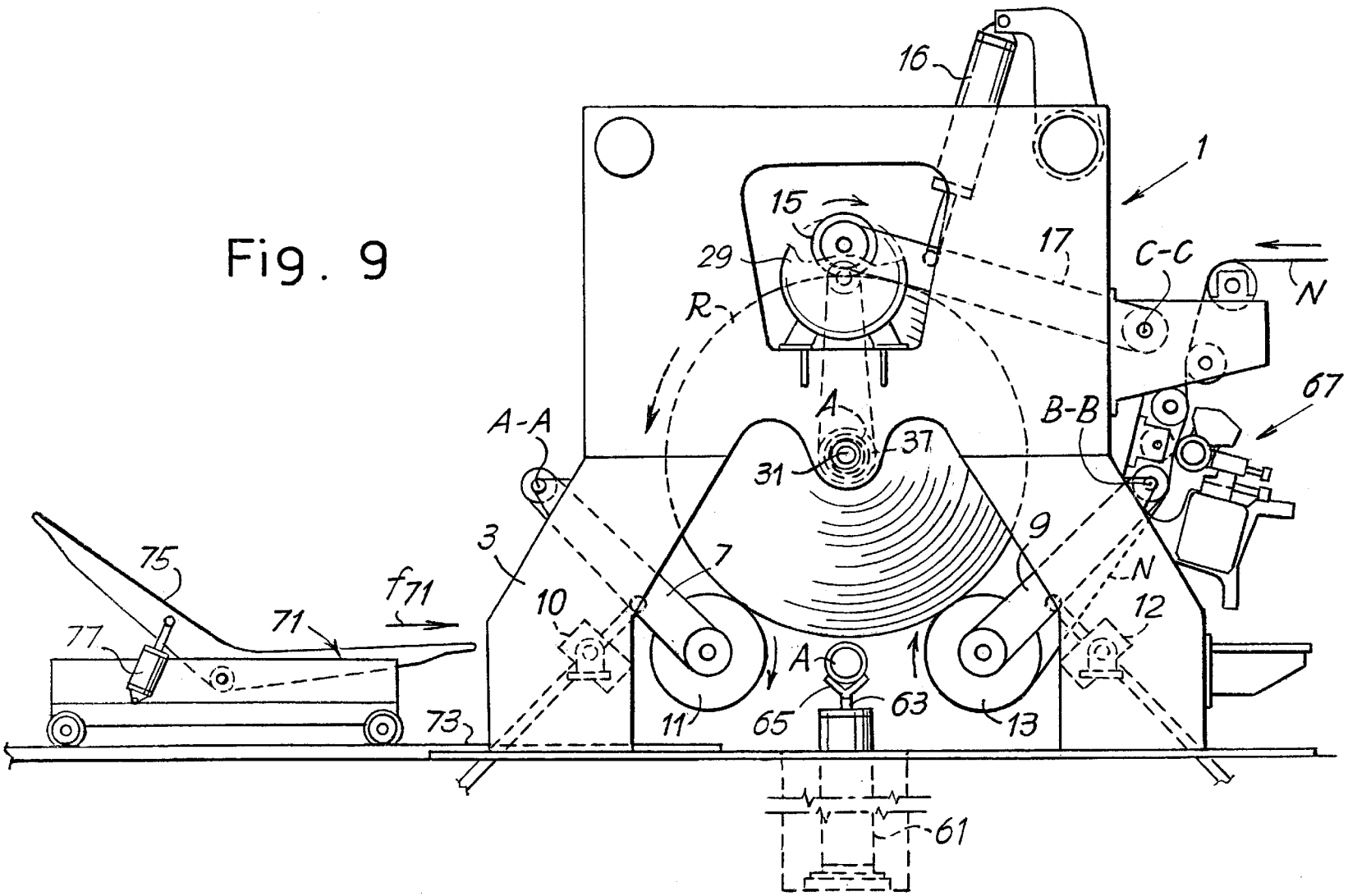

FIG. 9 shows the condition of the machine when the winding cycle has been completed and the reel R has reached its final diameter. The lower winding rolls 11, 13 are in their lowest position, while the upper winding roll 15 is in the raised position. At this point the reel R must be unloaded onto the cradle 75 of the carriage 71, the weblike material must be cut transversely to generate a new free end, and a new tubular core or new series of tubular cores must be inserted into the winding zone.

Figure 10:
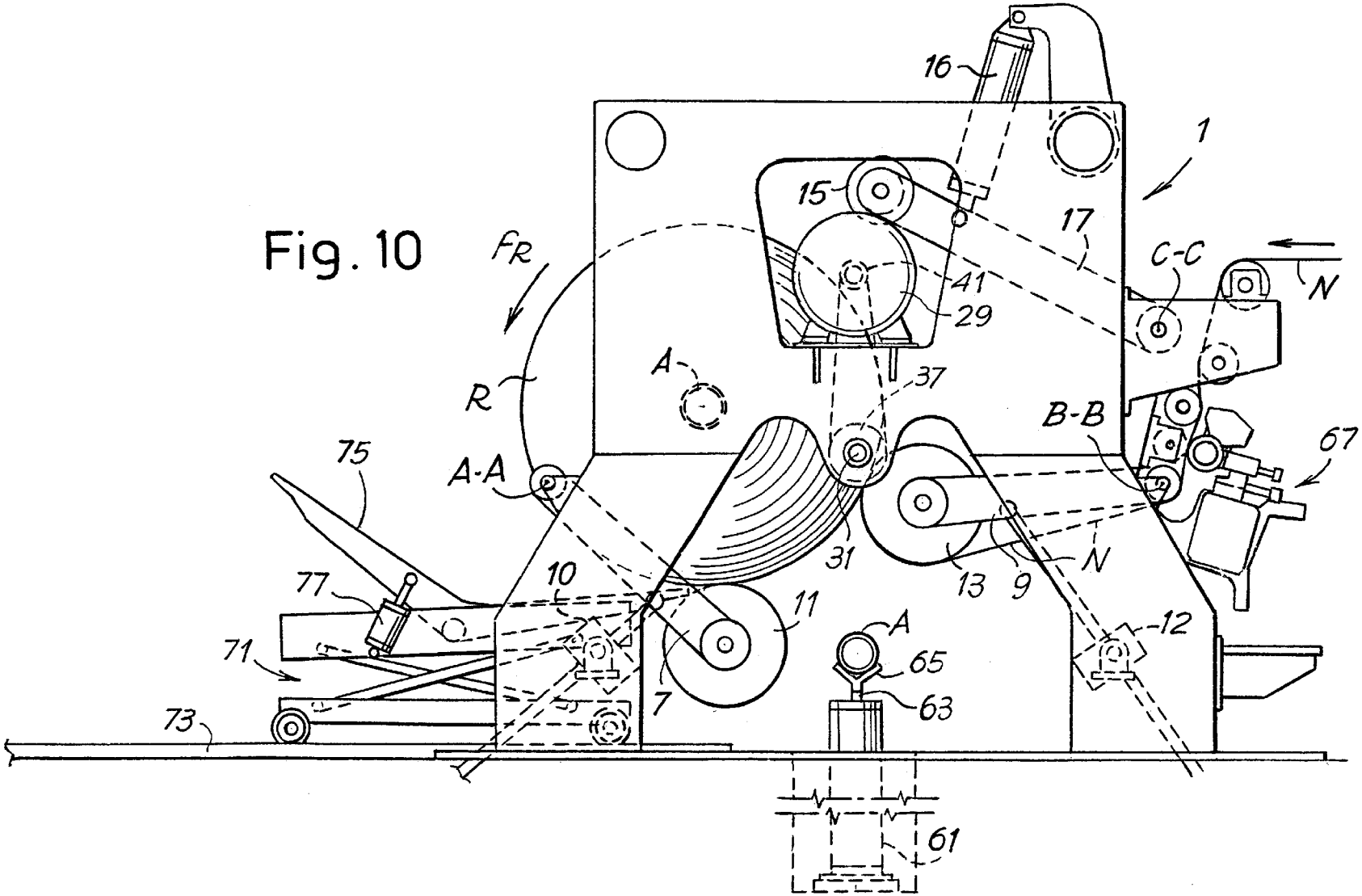

For this purpose the carriage 71 is brought up to the machine 1 by a movement in the direction shown by the arrow f71 (FIG. 9) along the tracks 73, and its top part, on which the cradle 75 is hinged, is raised to the position shown in FIG. 10. The mandrel 31 is reduced in size and withdrawn from inside the tubular cores A on which the reel R has been formed.

The lower winding roll 13, i.e. that furthest from the carriage 71, is pivoted up about the axis B—B while the upper winding roll 15 may if desired be moved further upward to facilitate the unloading of the reel R. In this way the reel R is unloaded from the cradle 75 by rolling it in the direction of the arrow fR over the lower winding roll 11. In the meantime a new series of cores A, provided with a line of glue applied in a manner known per se, has been placed in readiness on the section 65 of the core introducing means.

During unloading of the finished reel and insertion of the new cores A into the winding zone the weblike material has basically ceased to be fed in, except for a very small amount of material necessary to allow the reel R to roll into the tilting cradle 75 without tearing the weblike material.

Figure 11:
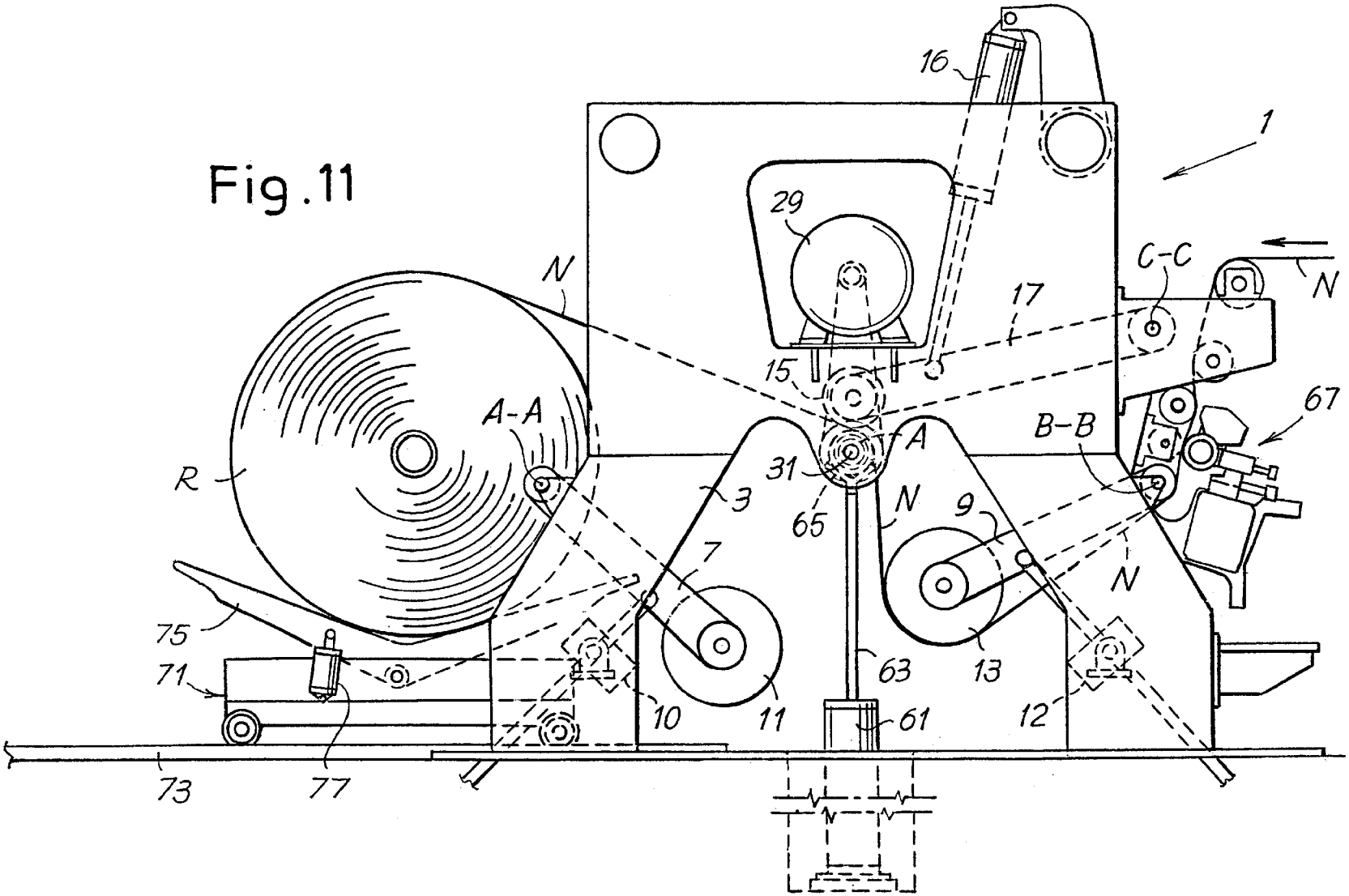

FIG. 11 shows the next stage, in which the reel R has been unloaded onto the cradle 75, and the latter has been pivoted by the actuator 77 and lowered back down. The lower winding roll 13 has again been lowered from the position of FIG. 10, for the purposes described later, the lower winding roll 11 is still in the down position and the upper winding roll 15 has been moved back down. A cutting system mounted on the pivoting arms 17 of the roll 15 can at this point cut the weblike material N transversely, between the reel R and the lower winding roll 13. The cutting means (not shown) may for example comprise a system of air nozzles, a retractable blade or other means known per se or otherwise within the capabilities of those skilled in the art. Alternatively the material may also be cut by means arranged differently but known per se.

The lowering of the lower winding roll 13 from the position of FIG. 10 to that of FIG. 11 allows the introducing means 63 of the cores A to be moved upward so that the V section 65 positions the new cores A in the winding zone, in line with the mandrel 31. To facilitate the introduction, without excessively lowering the roll 13, provision may be made for the introducing means 63 to have a stroke inclined to the vertical.

Once the cores are lined up with the mandrel, the mandrel is inserted axially into the tubular cores so that the introducing means 63 can then be lowered. Once the tubular cores have been raised above the lower winding roll 13 and the introducing means 63 retracted, the winding rolls 11, 13 can be raised again to return to the position of FIG. 8.

Lifting the cores into the winding zone may pinch the weblike material between the cores and the upper winding roll 15, and possibly also cause the weblike material to stick to the tubular cores because of the applied glue. At this point the position shown in FIG. 8 has been reached once again and a new winding cycle can be commenced.

Cutting may conveniently be synchronized with the movements, described above, of the rolls 11, 13 and of the introducing means 63.

Figure 12:
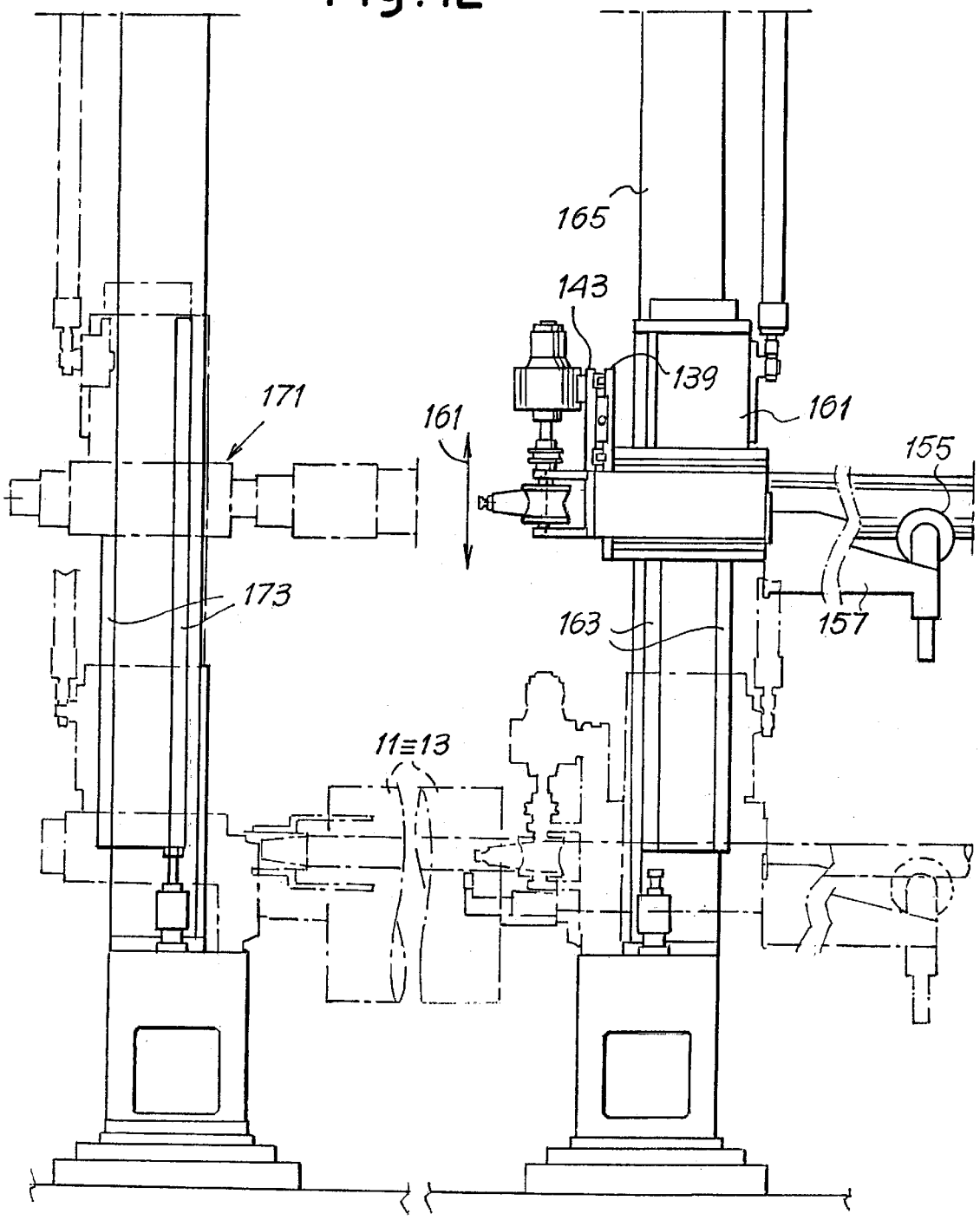
FIG. 12 shows a side view of a different mandrel drive system.
Figure 13:
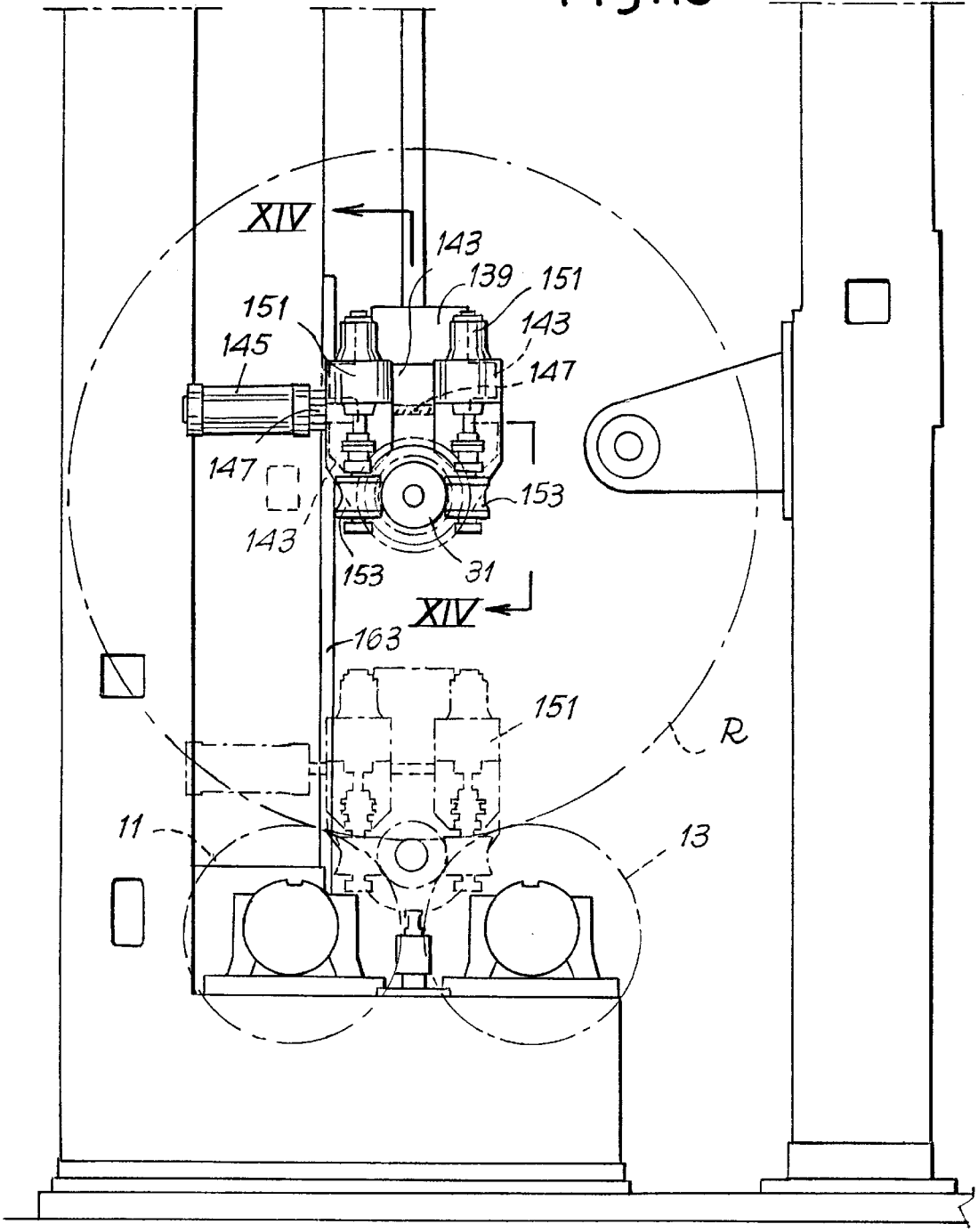
FIG. 13 shows a view on XIII—XIII as marked in FIG. 12.
Figure 14:
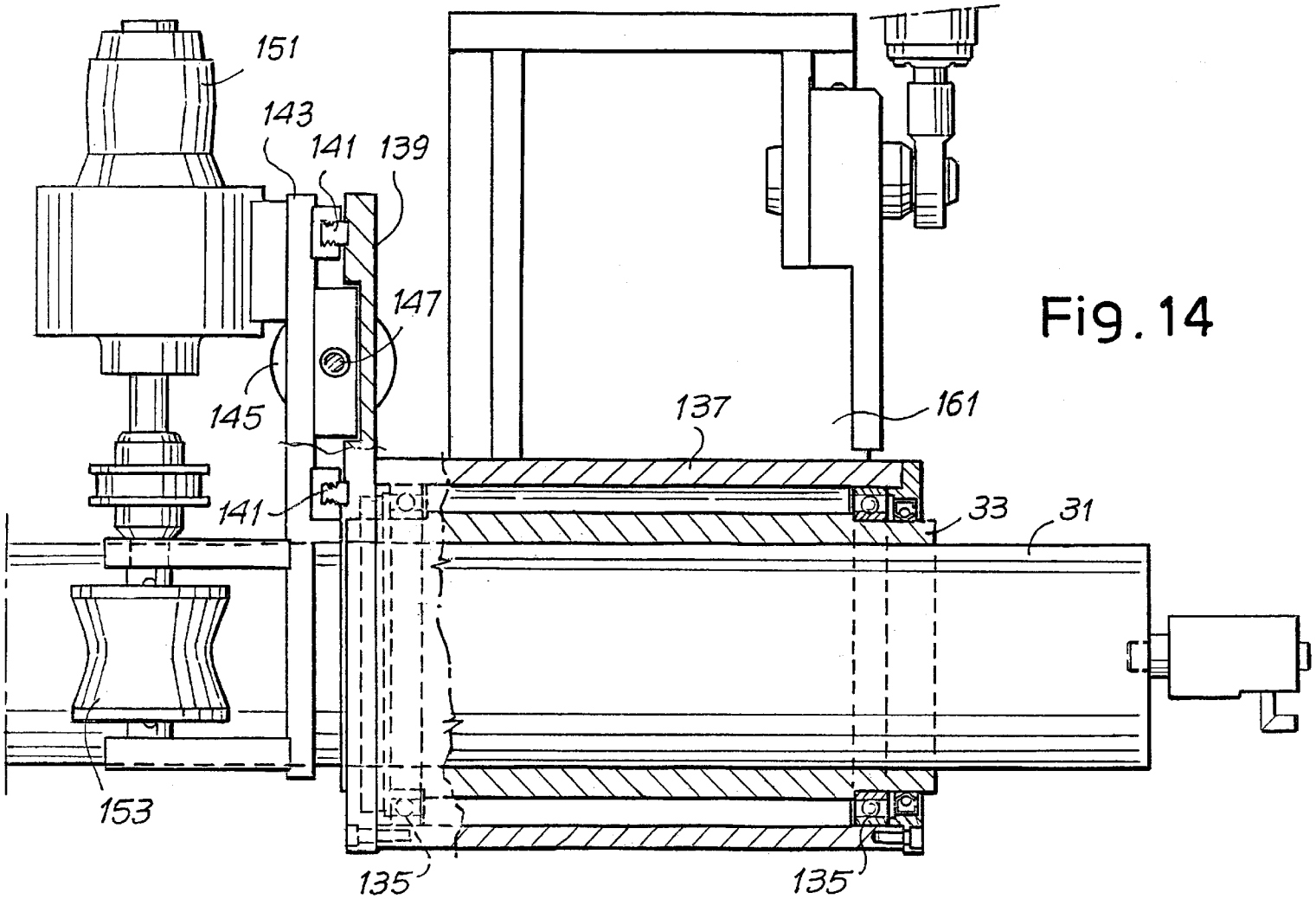
FIG. 14 shows an enlarged section on XIV—XIV as marked in FIG. 13.

FIGS. 12–14 show a different embodiment of the mandrel withdrawal and insertion device. These figures show an arrangement in which the mandrel and its associated insertion and withdrawal system are mounted on a vertically mobile slide. This enables this withdrawal system also to be used in a machine in which the lower winding rolls 11 and 13 are of fixed axis. The withdrawal and insertion device constructed as in FIGS. 4 and 5 could likewise be mounted on a raising and lowering system, for the same reasons.

In the embodiment shown in FIGS. 12–14 the mandrel, still numbered 31, is inserted axially into a sleeve still marked 33 and supported by bearings 135 in a housing 137. Fixed to the latter is a plate 139 supporting two horizontal guides 141. On these guides two slides 143 move in opposite directions along the guides 141 as shown by the arrow f143 (FIG. 13). The translational motion is provided by a motor 145 via a threaded bar 147.

Mounted on each slide 143 is a pneumatic or hydraulic motor 151 providing motion to a respective shaped roll 153 equivalent to the shaped roll, 47. The operation of the insertion and withdrawal device described above is similar to that of the device shown in FIGS. 4 and 5. The shaped rolls 153 are pressed, by the motor 145, against the cylindrical surface of the mandrel 31, and rotation in either direction by the motors 145 causes withdrawal or insertion of the mandrel relative to the winding zone.

Also shown in FIG. 12 is a supporting roll 155 mounted idly on a projecting bracket 157. This roll serves as a support for the mandrel 31 when the latter is drawn out of the winding zone by the shaped rolls 145. The number 171 indicates a mating center able to move vertically up and down on guides 173 on the opposite side frame from that where the shaped rolls 153 are located. The mating center holds the unsupported end of the mandrel 31.

Compared with the embodiment illustrated in FIGS. 3 and 4, the embodiment of FIGS. 12–14 is characterized by a reduction in the size and weight of the shaped rolls.

This makes simpler any movement in a vertical direction of the complete assembly made up of the shaped rolls, their associated drives and the support of the mandrel 31. In FIGS. 12–14 this assembly of mechanical members is mounted on a carriage 161 capable of vertical movement indicated by the double arrow f161 up and down vertical guides 163 fixed to the side frame 165 of the machine. In this way the mandrel 31 insertion and withdrawal device can also be mounted on rewinding machines in which the lower winding rolls 11, 13 have fixed axes. For these machines the possibility is not ruled out of also using a configuration of the type illustrated in FIGS. 4, 5 and 6, although that of FIGS. 12–14 is more advantageous owing to its reduced size and weight.

With an insertion and withdrawal device of this type it is possible to construct a rewinding machine for the production of reels of wound weblike material, of the type that comprises in combination: a pair of lower winding rolls defining a winding cradle and means for inserting an axial mandrel into said winding cradle. The means for inserting the mandrel comprise a pair of shaped rolls with actuators which move said shaped rolls into contact with the outer surface of the mandrel and with other actuators that rotate one or both of the shaped rolls in order to move the mandrel parallel to its own axis, in such a way as to give this mandrel alternate movements of insertion into the winding cradle and withdrawal from the winding cradle. If the winding rolls have fixed axes the mandrel insertion and withdrawal means are vertically movable in order to follow the growth of the reel as it develops on the rolls.

It will be understood that the drawing shows only an illustrative embodiment purely by way of a practical demonstration of the invention, which invention may be altered in its shapes and arrangements without thereby departing from the scope of the concept on which the invention is based. The presence of any reference numerals in the attached claims is for the purpose for facilitating the reading of the claims with reference to the drawings and does not limit the scope of protection thereof.

I claim:

1. A rewinding machine for the production of reels of wound weblike material, including: a pair of lower winding rolls defining a winding cradle and means for inserting an axial mandrel into said winding cradle comprising a pair of shaped rolls with actuators which move said shaped rolls into contact with the outer surface of the mandrel and with other actuators that rotate at least to one of the shaped rolls in order to move the mandrel parallel to its own axis.

2. A rewinding machine for the production of reels of weblike material, the machine comprising:

a pair of lower wining rolls defining a winding cradle, wherein said lower winding rolls are movable from an upper position toward a lower position during the winding of a reel, in order to keep the axis of the developing reel in an essentially fixed position;

an axial winding mandrel about which the winding of the reel takes place, said winding mandrel being supported in an essentially fixed axial position, said winding mandrel being axially movable for insertion into the winding zone and retraction from it; and a pair of motorized shaped rolls that engage on the external surface of said winding mandrel in order to move it axially.

3. A rewinding machine as claimed in claim 2, wherein said shaped rolls are adjustable to enable them to act on winding mandrels of variable diameter.

4. A rewinding machine for the production of reels of weblike material, the machine comprising:

a pair of lower winding rolls defining a winding cradle, wherein said lower winding rolls are movable from an upper position toward a lower position during the winding of a reel, in order to keep the axis of the developing reel in an essentially fixed position; and pivoting arms, said winding rolls being supported by said pivoting arms.

5. A rewinding machine as claimed in claim 4, further comprising:

an axial winding mandrel about which the winding of the reel takes place, said winding mandrel being supported in an essentially fixed axial position.

6. A rewinding machine as claimed in claim 5, wherein said winding mandrel is axially movable for insertion into the winding zone and retraction from it.

7. A rewinding machine as claimed in claim 5, wherein said winding mandrel is motorized and rotates about its own axis.

8. A rewinding machine as claimed in claim 4, including an inserter for tubular winding cores.

9. A rewinding machine as claimed in claim 8, wherein said inserter is situated underneath said lower winding rolls, in a central position relative to the axes of said lower winding rolls.

10. A rewinding machine as claimed in claim 4, further comprising: a third roll, said third roll being an upper winding roll.

11. A rewinding machine as claimed in claim 4, further comprising a carriage with a member for receiving the formed reels.

12. A rewinding machine as claimed in claim 11, wherein said carriage is movable perpendicularly to the axes of the winding rolls so as to approach the winding rolls for the unloading of the formed reels.

13. A rewinding machine as claimed in claim 10, wherein said third winding roll is carried by pivoting arms that carry members to cut the weblike material when winding is finished.

14. A method for the production of reels of wound weblike material, the method comprising the steps of:

forming a reel on a pair of supporting lower wining rolls;

winding of the reel of weblike material about an axial winding mandrel to wind the reels onto tubular cores placed on the mandrel;

gradually lowering the winding rolls during the winding of the reel, in order to keep the axis of the developing reel in an essentially fixed position;

unloading the reel from the winding rolls so that a new winding cycle can be commenced when the winding of a reel is finished; and after the winding of a reel is finished and has been unloaded from the winding zone, moving a new tubular core into the winding zone while one of the winding rolls is in a raised position and the other in a lowered position and inserting the mandrel into the core introduced into the winding zone, and then raising the winding roll in the lowered position.

15. A method for the production of reels of wound weblike material, the method comprising the steps of:

forming a reel on a pair of supporting lower winding rolls;

gradually lowering the winding rolls during the winding of the reel by a pivoting movement about axes perpendicular to the direction in which the weblike material is fed, in order to keep the axis of the developing reel in an essentially fixed position; and unloading the reel from the winding rolls so that a new winding cycle can be commenced when the winding of a reel is finished.

16. A method as claimed in claim 15, wherein the winding of the reel of weblike material takes place about an axial winding mandrel.

17. A method as claimed in claim 16, wherein said axial winding mandrel is moved axially for insertion into the winding zone and removal from it when winding is finished.

18. A method as claimed in claim 15, wherein when winding is finished, one of the lower winding rolls is raised in order to unload the formed reel by causing it to roll over the other winding roll.

19. Method as claimed in claim 16, wherein said reels are wound onto tubular cores placed on said mandrel.

20. A rewinding machine for the production of reels of weblike material, the machine comprising:

a pair of lower winding rolls defining a winding cradle, wherein said lower winding rolls are movable from an upper position toward a lower position during the winding of a reel, in order to keep the axis of the developing reel in an essentially fixed position, said laid lower winding rolls move apart from each other during said movement toward a lower position.

21. A rewinding machine as claimed in claim 20, including an axial winding mandrel about which the winding of the reel takes place, said winding mandrel being supported in an essentially fixed axial position.

22. A rewinding machine as claimed in claim 21, wherein said winding mandrel is axially movable for insertion into the winding zone and retraction from it.

23. A rewinding machine as claimed in claim 21, wherein said winding mandrel is motorized and rotates about its own axis.

24. A rewinding machine as claimed in claim 21, wherein said winding mandrel is expandable.

25. A rewinding machine as claimed in claim 22, further comprising: a pair of motorized shaped rolls that engage on the external surface of said wining mandrel in order to move it axially.

26. A rewinding machine as claimed in claim 25, wherein said shaped rolls are adjustable to enable them to act on winding mandrels of variable diameter.

27. A rewinding machine as claimed claim 20, wherein lower winding rolls are supported by pivoting arms.

28. A rewinding machine as claimed in claim 20, further comprising: an inserter for tubular winding cores.

29. A rewinding machine as claimed in claim 28, wherein said inserter is situated underneath said lower winding rolls, in a central position relative to the axes of said lower winding rolls.

30. A rewinding machine as claimed in claim 20, further comprising: a third winding roll provided as an upper winding roll.

31. A rewinding machine as claimed in claim 20, further comprising: a carriage with a member for receiving the formed reels.

32. A rewinding machine as claimed in claim 30, wherein said carriage is movable perpendicularly to the axes of the winding rolls so as to approach the winding rolls for the unloading of the formed reels.

33. A rewinding machine as claimed in claim 30, wherein said third winding roll is carried by pivoting arms that carry members to cut the weblike material when winding is finished.

34. A method for the production of reels of wound weblike material, the method comprising the steps of:

forming a reel on a pair of supporting lower winding rolls;

gradually lowering the winding rolls during the winding of the reel by a pivoting movement about axes perpendicular to the direction in which the weblike material is fed, in order to keep the axis of the developing reel in an essentially fixed position, said laid lower winding rolls moving apart from each other during said gradual lowering of the winding rolls such that the points of contact of the reel and the winding rollers move apart, providing a support action.

35. method as claimed in claim 34, wherein the winding of the reel of weblike material takes place about an axial winding mandrel.

36. A method as claimed in claim 35, wherein said axial winding mandrel is moved axially for insertion into the winding zone and removal from it when winding is finished.

37. A method as claimed in claim 34, wherein when winding is finished, one of the lower winding rolls is raised in order to unload the formed reel by causing it to roll over the other winding roll.

38. A method as claimed in claim 35, wherein said reels are wound onto tubular cores placed on said mandrel.

39. A method as claimed in claim 38, wherein when the winding of a reel is finished, and after it has been unloaded from the winding zone, a new tubular core is moved into the winding zone while one of the winding rolls is in a raised position and the other in a lowered position, said mandrel is inserted into the core introduced into the winding zone, and the winding roll in the lowered position is then raised.

40. A method as claimed in claim 34, wherein said winding rolls are gradually lowered by a pivoting movement about axes perpendicular to the direction in which the weblike material is fed.

* * * * *

UNITED STATES PATENT AND TRADEMARK OFFICE

CERTIFICATE OF CORRECTION

PATENT NO. : 6,199,789 B1
DATED : March 13, 2001
INVENTOR(S) : Marco Celli

It is certified that error appears in the above-identified patent and that said Letters Patent is hereby corrected as shown below:

Title page,
Item [75], Inventor, should read as follows: -- [75] Inventor: Marco Celli, Capannori (IT) --

Signed and Sealed this

Sixth Day of August, 2002

*Attest:*

*Attesting Officer*

JAMES E. ROGAN
*Director of the United States Patent and Trademark Office*